US005441265A

United States Patent [19]

Codlin

[11] Patent Number: 5,441,265

[45] Date of Patent: Aug. 15, 1995

[54] PRACTICE PUTTING GREENS WITH VARIABLE CONTOURS

[76] Inventor: Kenneth H. Codlin, 17 North Alarton Street, Mississauga, Ontario, Canada, L4T 1J7

[21] Appl. No.: 181,794

[22] Filed: Jan. 18, 1994

[51] Int. Cl.[6] ..... A63B 69/36

[52] U.S. Cl. ..... 273/176 H

[58] Field of Search ..... 273/176, 32 R, 34 R, 273/181 R, 181 A, 55 R, 195 R

[56] References Cited

U.S. PATENT DOCUMENTS 3,690,673 9/1972 Occhipinti ..... 273/176 H
3,892,412 7/1975 Koo ..... 273/176 H

FOREIGN PATENT DOCUMENTS 2072022 9/1981 United Kingdom ..... 273/176 H

*Primary Examiner*—Mark S. Graham

[57] ABSTRACT

A practice putting green with variable contours comprising a frame structure fabricated of a rigid material with a periphery and downwardly extending side walls and a base, a plurality of vertically extending interior walls of the approximate height of the side walls dividing the area between the side walls into a predetermined number of inflation zones, at least one golf hole extending downwardly from an elevation substantially the same as the upper edges of the interior walls and the side walls for receiving a putted golf ball, a plurality of valves formed in the peripheral side wall, each of the valves adapted to provide pressurized air to one of the plenum chambers and elastomeric material located over the area above the manifolds between the peripheral side walls with means to couple the elastomeric material to the frame structure between the various zones to seal the zones one from another.

1 Claim, 3 Drawing Sheets

PRACTICE PUTTING GREENS WITH VARIABLE CONTOURS

BACKGROUND OF THE INVENTION

1. Field of the Invention

The present invention relates to practice putting greens with variable contours and more particularly pertains to varying the contours of practice putting surfaces for improving a player's putting capabilities.

2. Description of the Prior Art

The use of practice putting greens is known in the prior art. More specifically, devices for practicing one's putting stroke heretofore devised and utilized for the purpose of improving one's putting stroke is known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 3,690,673 a golf putting green simulator including an enclosed support member having a defined configuration over which synthetic grass is extended to provide a putting surface.

U.S. Pat. No. 4,886,274 discloses a portable practice putting green having a putting surface band, a cup at one end of it, a square angle on the other end of it, and a rebound bar replaceably put on either side of the square angle or near the hole for rebounding golf balls.

U.S. Pat. No. 4,930,784 discloses a portable artificial putting green capable of being deployed over a variety of surfaces, so constructed as to take on the shape of the underlying surface on which it is placed.

U.S. Pat. No. 4,978,127 discloses a selectively contourable putting green including an elongated platform having a rigid sub-base supporting a flexible resilient base, which in turn supports a flexible putting surface.

U.S. Pat. No. 5,002,280 discloses an adjustable putting green which includes an enclosure for receiving a foldable playing surface characterized by a flexible material resembling an artificial grass-like ground covering mounted on a folding support carried by a folding frame, which frame and support are extendible from the enclosure for playing purposes and foldable inside the enclosure for storage.

U.S. Pat. No. 5,100,145 discloses a golf putting assembly comprising a playing surface having a target hole, elevation means for adjusting the topography of the playing surface, and ball return means that elevate an entire section at the end of the playing surface nearest the target hole such than a incline is created, the including causing any balls thereon to move away from the incline.

In this respect, the practice putting greens with variable contours according to the present invention substantially departs from the conventional concepts and designs of the prior art, and in doing so provides an apparatus primarily developed for the purpose of varying the contours of practice putting surfaces for improving a player's capabilities.

Therefore, it can be appreciated that there exists a continuing need for new and improved practice putting greens with variable contours which can be used for varying the contours of practice putting surfaces for improving a player's capabilities. In this regard, the present invention substantially fulfills this need.

SUMMARY OF THE INVENTION

In view of the foregoing disadvantages inherent in the known types of practice putting greens now present in the prior art, the present invention provides improved practice putting greens with variable contours. As such, the general purpose of the present invention, which will be described subsequently in greater detail, is to provide a new and improved practice putting green with variable contours and method which has all the advantages of the prior art and none of the disadvantages.

To attain this, the present invention essentially comprises a practice putting green with variable contours comprising in combination a frame structure fabricated of a rigid material with in a circular configuration and downwardly extending side walls and a base, a plurality of vertically extending interior walls of the approximate height of the side walls dividing the area between the side walls into a predetermined number of inflation zones, a plurality of rigid golf holes extending downwardly from an elevation substantially the same as the upper edges of the interior walls and the side walls for receiving putted golf balls, a plurality of valves formed in the peripheral side wall, each of the valves adapted to provide pressurized air to one of the plenum chambers, a first layer of air impervious elastomeric material located over the area above the manifolds between the peripheral side walls, means to couple the air impervious material to the frame structure between the various zones to seal the zones one from another, a supplemental elastomeric sheet positioned over the air impervious material to constitute a continuous putting surface having a contour as the function of the pressure of air within the various manifolds, operator control means to relieve the pressure within the various manifolds and a putting pad at an elevation equal to that of the elevation of the side walls for placing the ball to be putted onto the upper surface of the supplemental sheet.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved practice putting greens with variable contours which have all the advantages of the prior art practice putting greens and none of the disadvantages.

It is another object of the present invention to provide new and improved practice putting greens with variable contours which may be easily and efficiently manufactured and marketed.

It is further object of the present invention to provide new and improved practice putting greens with variable contours which are of durable and reliable constructions.

An even further object of the present invention is to provide new and improved practice putting greens with variable contours which are susceptible of a low cost of manufacture with regard to both materials and labor, and which accordingly are then susceptible of low prices of sale to the consuming public, thereby making such practice putting green with variable contours economically available to the buying public.

still yet another object of the present invention is to provide new and improved practice putting greens with variable contours which provide in the apparatuses and methods of the prior art some of the advantages thereof, while simultaneously overcoming some of the disadvantages normally associated therewith.

Lastly, it is an object of the present invention to provide a new and improved practice putting green with variable contours comprising a frame structure fabricated of a rigid material with a periphery and downwardly extending side walls and a base, a plurality of vertically extending interior walls of the approximate height of the side walls dividing the area between the side walls into a predetermined number of inflation zones, at least one golf hole extending downwardly from an elevation substantially the same as the upper edges of the interior walls and the side walls for receiving a putted golf ball, a plurality of valves formed in the peripheral side wall, each of the valves adapted to provide pressurized air to one of the plenum chambers and elastomeric material located over the area above the manifolds between the peripheral side walls with means to couple the elastomeric material to the frame structure between the various zones to seal the zones one from another.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
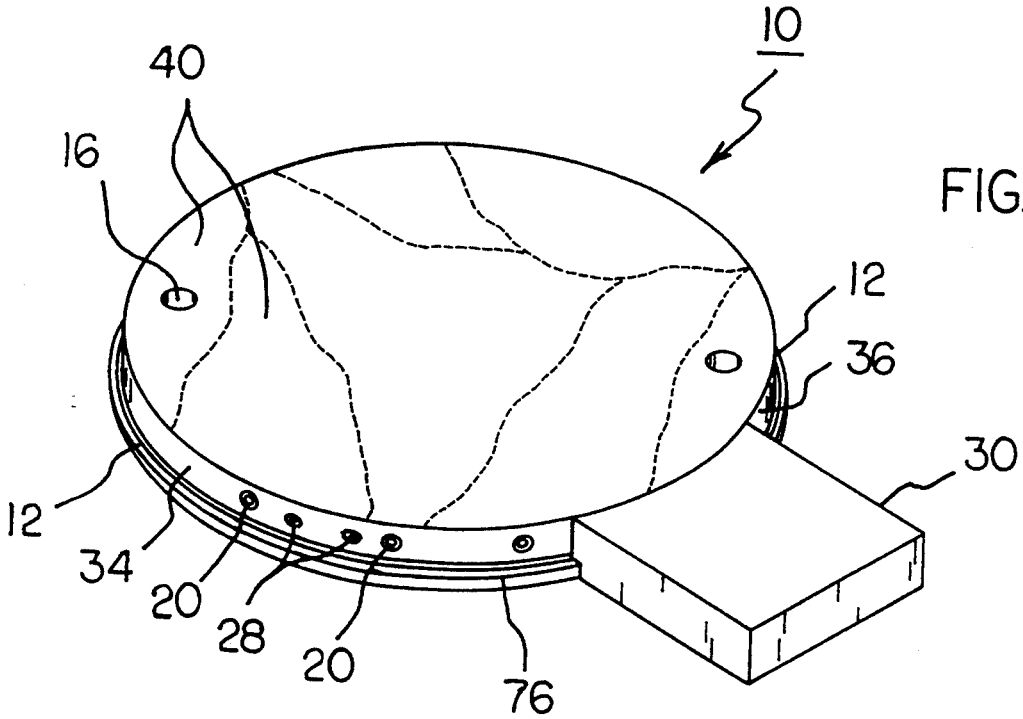
FIG. 1 is a perspective illustration of the preferred embodiment of the new and improved practice putting greens with variable contours constructed in accordance with the principles of the present invention.
Figure 2:
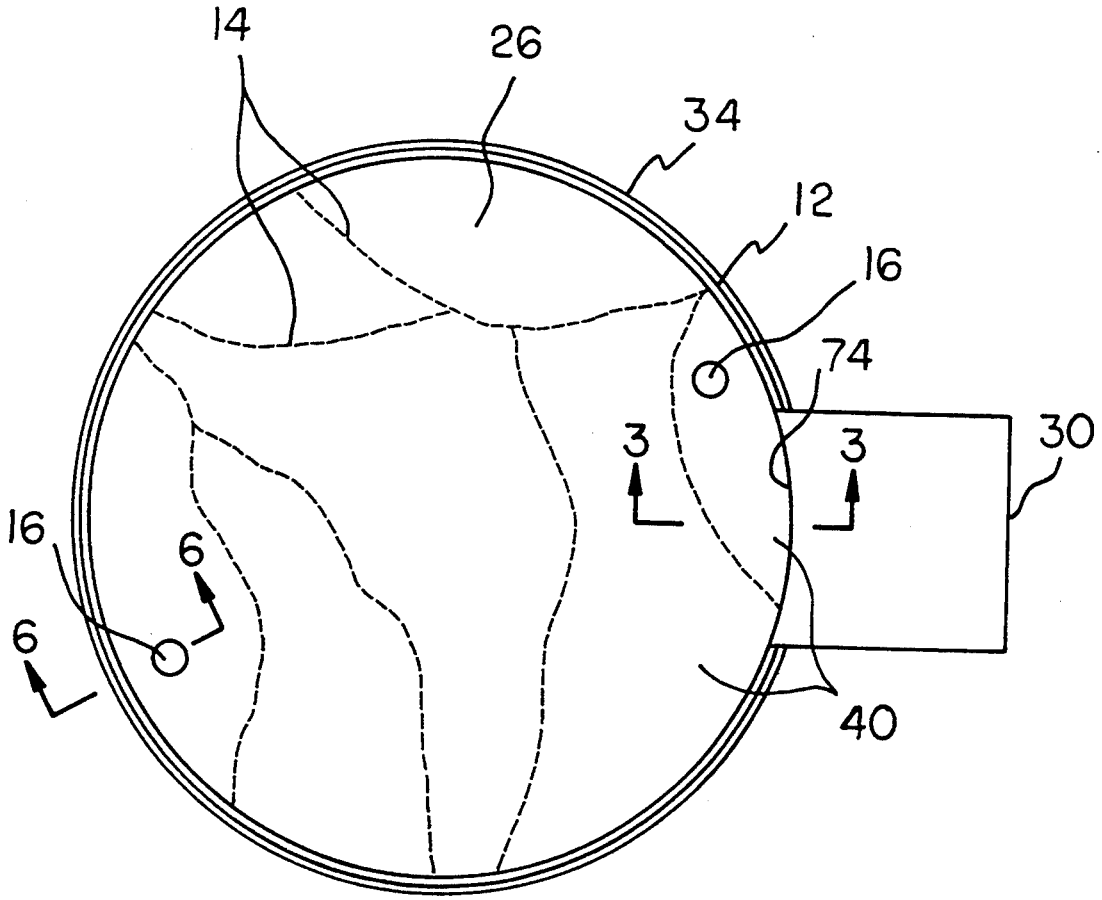
FIG. 2 is a top plan view of the device illustrated in FIG. 1.
Figure 3:
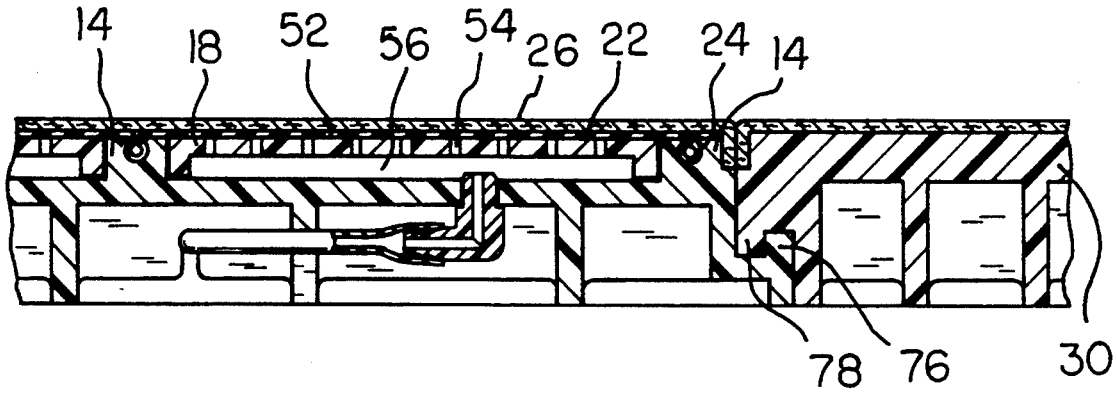
FIG. 3 is a cross-sectional view taken along lines 3—3 of FIG. 2.
Figure 4:
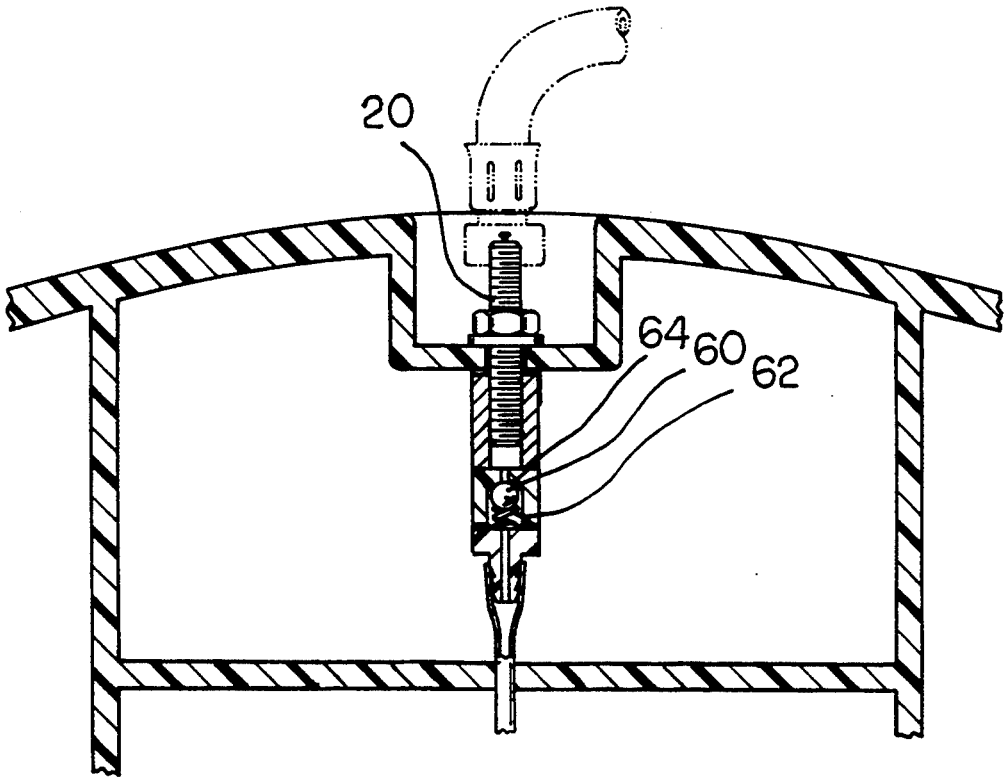
FIG. 4 is a cross-sectional view of the air inlet zone of the device of the prior Figures.
Figure 5:
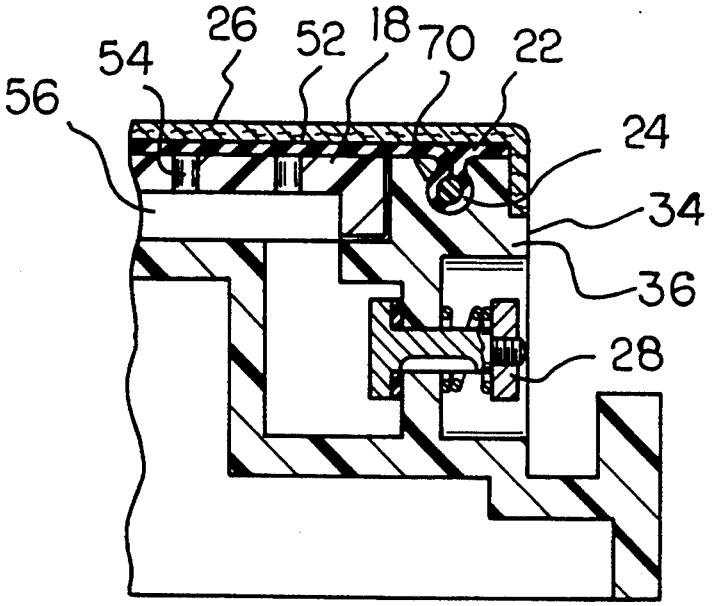
FIG. 5 is a cross-sectional view taken along one of the air outlet zones.
Figure 6:
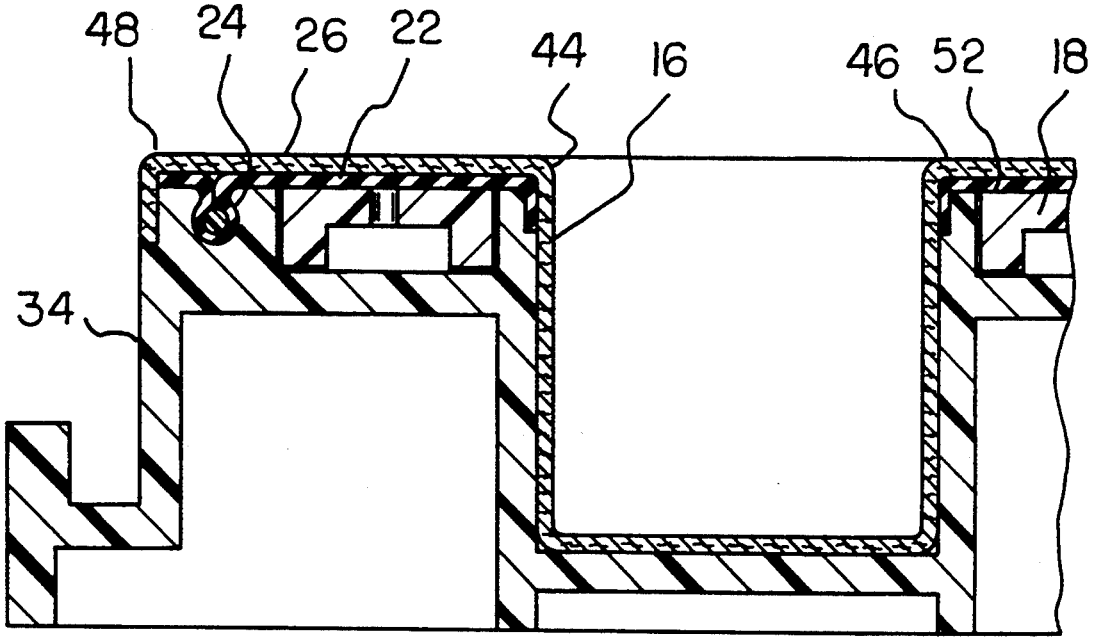
FIG. 6 is a cross-sectional view taken along lines 6—6 of FIG. 2.

With reference now to the drawings, and in particular to FIG. 1 thereof, the preferred embodiment of the new and improved practice putting green with variable contours embodying the principles and concepts of the present invention and generally designated by the reference numeral 10 will be described.

Specifically, the present invention, in its broadest context, is a system 10 which includes a frame structure 12, interior walls 14, golf holes 16, manifolds 18, valves 20, a first layer of elastomeric material 22, with means 24 to couple such material to the frame structure, a supplemental elastomeric sheet 26, pressure relief means 28 and a putting pad 30. Such components are individually constructed and related one with respect to the other to achieve the intended objectives.

More specifically, the frame structure 12 is fabricated of a rigid material. Any of the rigid plastics such as polyethylene, polypropylene, polyurethane, or the like could be utilized. Similarly, such frame structure 12 could be constructed of a rigid metal. The frame structure is fabricated to have a circular configuration with an external periphery 34. It also includes downwardly extending side walls 36 which define the outer boundaries of the frame structure. The next major component of the system 10 are a plurality of interior walls 14. Such walls 14 are oriented vertically and extend from the side walls 36 to an interior extent of the frame structure 12. The interior walls extend upwardly to a height essentially equal to that of the side walls. The interior walls are so configured and positioned to have at least one portion thereof defined by a portion of the side walls 36. The interior walls 14 in combination with the segments of the side walls 36 thus define areas between the side walls corresponding to a predetermined number of inflation zones 40. Each of the inflation zones is adapted to be inflated or deflated individually to vary the contour of the putting surface thereabove in a pattern as desired by the golfer using the system 10 of the present invention.

In using the present system, as in putting on a regulation golf course green, the objective is to strike a ball with a putter and roll it toward and into a hole. As a result, at least one hole 16 is provided in the upper surface of the system 10 of the present invention. In the preferred embodiment two such holes 16 are formed. The upper edge 44 of the hole is at an elevational height substantially equal to that of the upper edges 46 and 48 of the interior walls 14 and the side walls 36. The purpose of the hole or holes is for receiving putted golf balls.

Also located at an elevational height essentially the same as the upper edge of the side walls and holes are a plurality of manifolds. The upper surfaces 52 of the manifolds lie in a common plane. Such upper surfaces are provided with a plurality of apertures therethrough for the flow of pressurized air. The configuration of each manifold generally conforms to the shape of the individual hole 54 in which the individual manifold is located.

Each of the manifolds 18 has a plenum chamber 56 which is an enclosed air space except for the holes 54 thereabove. Pressurized air is fed to the individual plenum chambers 56 through a valve 20. Each such valve is physically located in the frame structure 12 at an associated point on the side wall 36. Such valve includes a ball 60 and a spring 62 urging the ball into a feeling engagement with an orifice 64. Pressurized air through any valve 20 will unseat the ball to allow introduction of pressurized air into the plenum chamber 56 associated with such valve. Such pressurized air is for contouring the particular inflation zone 40 of the system 10.

Located above the upper surface of the side walls 36, interior walls 14 and manifolds 18 is a first layer of air-impervious elastomeric material 22. Preferred materials for such layer are rubber, natural or synthetic, including blends thereof with appropriate additives for the intended function. Such first layer of material 22 is located over the manifolds between the peripheral side walls. In the areas where the first layer of material 22 is above the upper edges of the interior walls 14, such material is deformed to create a sealing contact between such material and the internal wall. In the disclosed embodiment, vertically extended recesses 70 are formed in the upper surfaces of the interior walls. The material thereabove is then pressed into such recesses. As a result, sealed compartments for inflation zones 40 are thus created in the individual areas defined by the interior walls 14 and side walls 36. As such, each of the inflation zones 40 may be inflated and configured to a desired shape independent of the shape of the other inflation zones thereadjacent. As a result, the putting surface for use by a golfer and defined by the zones and inflation of the zones may be tailored to the particular user's desires or needs.

Unfortunately, the first layer defines seams in the areas above the upper edges of the various interior walls 14. The detrimental effect which would be generated by such seams is overcome by a supplemental or second layer of elastomeric sheet material 26. Such supplemental sheet material 26, like the first elastomeric material 22 is formed of an elastomeric sheet preferably of a smooth seamless construction. It is elastomeric to allow it to deform with the deformation of the first elastomeric material into a desired contour of a putting surface. The upper or exposed surface of the supplemental elastomeric sheet is preferably formed as with a felted fabric to more accurately simulate the action of a putting surface as it controls the rolling of a putted golf ball thereover.

Next provided are an operator controlled pressure relief valve 28. One such relief valve is formed in various segments of the side walls 36 of the frame structure 12 corresponding to the various inflation zones 40. In this manner, when any zone is inflated to a predetermined pressure to effect a lesser or greater deformation of the putting surface, the height of such contour may be reduced by allowing air to escape from such zone through the opening of the relief valve 28 to a particular extent as may be desired by the user.

The last component of the system is a putting pad 30. The putting pad is a box-like member with an upper surface 72 at an elevational height essentially equal to that of the upper edges of the side walls 36 and interior walls 14 as well as the putting surface, the upper surface of the supplemental elastomeric sheet 26. It is constructed of a rigid material of the type employed for the frame structure 12. It will thus allow a user practicing his putting to stand thereon and place a ball for being stroked. One face 74 of the putting pad 30 is curved to correspond with the curvature of the side walls 36 of the frame structure 12. Due to this mating relationship between pad 30 and frame structure 12, the pad may be located anywhere around the periphery of the frame structure to provide different putts to be practiced. On the surfaces of the pad 30 and frame structure 12 facing each other, there is provided a locking lip 76 and mating recess 78 for coupling such pad and frame structure together during operation and use.

The most difficult part of golf is the putting. Therefore, the present invention is an effective way to become a better putter. It can be used anytime, anywhere and by everyone.

Even if one is an experienced putter, he or she can still use the present invention to maintain the consistency of one's putting. This is true especially in the winter when getting to the golf course is virtually impossible.

If one is having trouble with certain holes on the golf course, one can still use the present invention the same way and practice shots to improve one's game.

For the beginner and up and coming golfers, the present invention would be beneficial to learn the skills that one would need to become a superior putter.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved practice putting green with variable contours comprising, in combination:

a frame structure fabricated of a rigid material within a circular configuration and downwardly extending peripheral side walls with upper edges and lower edge and a base;

a plurality of vertically extending interior walls with upper edges and lower edges and of the approximate height of the side walls dividing the entire area between the side walls into a predetermined number of inflation zones, each such inflation zone being formed by adjacent interior walls of adjacent zones with each inflation zone terminating at a portion of the peripheral side walls;

a plurality of rigid golf holes extending downwardly from an elevation substantially the same as the upper edges of the interior walls and the side walls for receiving putted golf balls;

a plurality of valves formed in the peripheral side walls, each of the valves adapted to provide pressurized air to one of the inflation zones;

a first layer of air impervious elastomeric material located over the area above the inflation zones between the peripheral side walls;

means to couple the air impervious material to the frame structure between the various inflation zones to seal the inflation zones one from another;

a supplemental elastomeric sheet positioned over the air impervious material to constitute a continuous putting surface having a contour as the function of the pressure of air within the various inflation zones;

operator control means to relieve the pressure within the various inflation zones; and a putting pad at an elevation equal to that of the elevation of the side walls for placing the ball to be putted onto the upper surface of the supplemental sheet.

* * * * *